United States Patent [19]

Hopper

[11] Patent Number: 4,642,949

[45] Date of Patent: Feb. 17, 1987

[54] METHOD OF JOINING CURVILINEAR STRUCTUAL INSULATING PANELS AND THE LIKE AND IMPROVED JOINED PANEL STRUCTURE

[75] Inventor: Thomas P. Hopper, Concord, N.H.

[73] Assignee: Kalwall Corp., Manchester, N.H.

[21] Appl. No.: 844,838

[22] Filed: Mar. 27, 1986

[51] Int. Cl.[4] ..... E04B 1/32

[52] U.S. Cl. ..... 52/80; 52/245; 52/741

[58] Field of Search ..... 52/80, 82, 86, 245, 52/741, 745

[56] References Cited

U.S. PATENT DOCUMENTS

| | | | |
|---|---|---|---|
| 3,640,034 | 2/1972 | Shotwell | 52/82 |
| 3,921,555 | 11/1975 | Suzuki et al. | 52/80 X |
| 3,999,337 | 12/1976 | Tomassett et al. | 52/82 |
| 4,064,663 | 12/1977 | Moss | 52/80 |
| 4,413,452 | 11/1983 | Wilkinson | 52/82 |
| 4,557,090 | 12/1985 | Keller, Sr. | 52/245 |

FOREIGN PATENT DOCUMENTS

| | | | |
|---|---|---|---|
| 2422867 | 11/1975 | Fed. Rep. of Germany | 52/82 |

*Primary Examiner*—J. Karl Bell

*Attorney, Agent, or Firm*—Rines and Rines, Shapiro and Shapiro

[57] ABSTRACT

A method of cutting curvilinear panels with ellipsoidal cuts and joining the abutted edges of the same with a slight gap therebetween by batten-like surfaces overlapping the edges on both the outer and inner cover sheets of the panel and sealing the gap therebetween—the batten-like surfaces being preferably bonded layers, and the method being adapted to accomodate complicated joining seams, bends and curves.

16 Claims, 14 Drawing Figures

METHOD OF JOINING CURVILINEAR STRUCTUAL INSULATING PANELS AND THE LIKE AND IMPROVED JOINED PANEL STRUCTURE

The present invention relates to methods of and apparatus for joining curvilinear structural insulating panels and the like, as described, for example, in U.S. Pat. No. 4,557,090, being more particularly directed to the joining of such panels along curved seams, bends and intersections and to the problem of providing a minimum width joint especially useful for aesthetic purposes when the panels are also translucent or otherwise light-transmitting.

While sheet glass or plastic panels and the like are readily joinable at bends or intersections with abutting normal cut edges and relatively narrow battens of aluminum or other metal edge-overlapping strips applied normal to the edge cuts, such techniques are not directly applicable to joining structures of relatively thick profile (several inches, as an illustration) such as the curvilinear panels above-mentioned, having separated co-extensive parallel outer and inner flexible fiberglass or similar sheets internally supported by longitudinal I-beam mullions and transverse interconnecting rib or munton support members, as described in said patent.

Underlying the present invention is the discovery that by specially designed and tailored edge cuts defining different somewhat ellipsoidal curves for each of the outer panel sheet edges, said appropriate interior closure strips just inward of the cut and usually at a varying or changing acute angle to the normal between the inner and outer parallel panel cover sheets, minimal width joining of abutting edges of adjacent curvilinear panels can be effected even along seams that have no substantial straight portions and have very complicated curves, as, for example, when vault roof construction of different heights and radii are to be joined, or special shaped arches or curved bends are required.

An object of the present invention, accordingly, is to provide a novel method of preparing and joining curvilinear panels and the like that can accomodate for such complicated (and, of course, simpler) joinder curves, bends or shapes.

A further object is to provide a novel joined curvilinear panel structure, as well.

Other and further objects will be described hereinafter and are more particularly delineated in the appended claims.

In summary, however, from one of its viewpoints, the invention embraces a method of joining curvilinear structural panels and the like having inner and outer parallel cover sheets held spaced apart by substantially longitudinally and transversely extending internal support members, that comprises, determining the lines of desired joining of adjacent panels; transversely cutting the panels to provide panel edges accomodating such a joining with substantially ellipsoidal transverse cuts, the ellipses for the outer and inner cover sheets being different and the internal support members being correspondingly cut along varying diagonal directions to the normal between the panel cover sheets; abutting a pair of panels thus cut that are to be joined with a small gap therebetween; and joining the abutting panels with a weather-sealing and structurally connecting batten-like joint overlapping said edges both along the outer and inner panel cover sheet edges. Preferred and best mode embodiments and details, including novel joined structural panel constructions, are later presented.

The invention will now be described with reference to the accompanying drawing,

FIG. 1 of which is an isometric view illustrative of an architecturally aesthetic intersection of different height, orientation and radii curved vaults of curvilinear panels, presenting a difficult complex curved seam or joinder requirement readily accomodated by the present invention;

Figure 1:
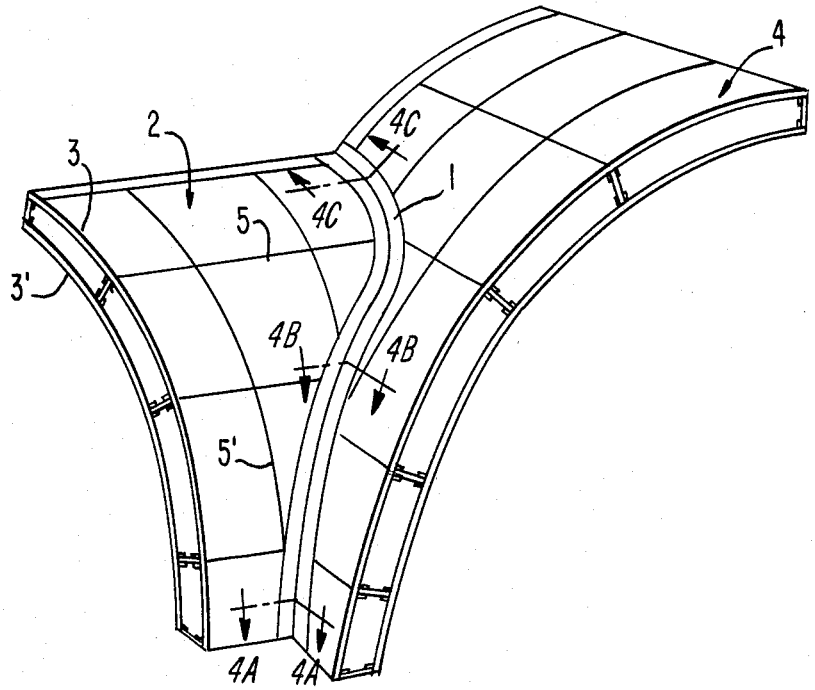
Figure 4A:
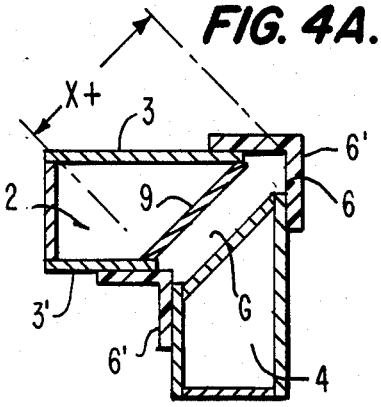
Figure 5A:
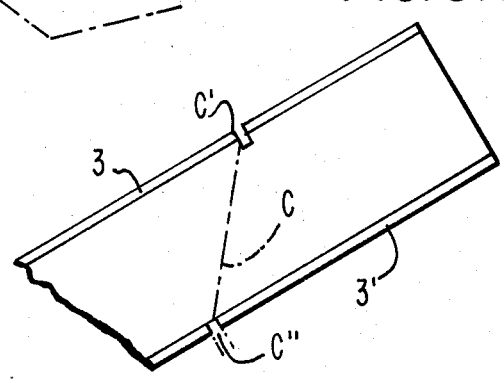
Figure 5B:
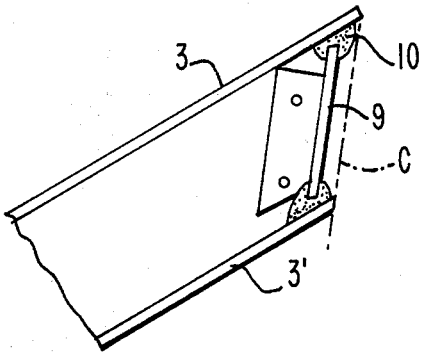
Figure 6:
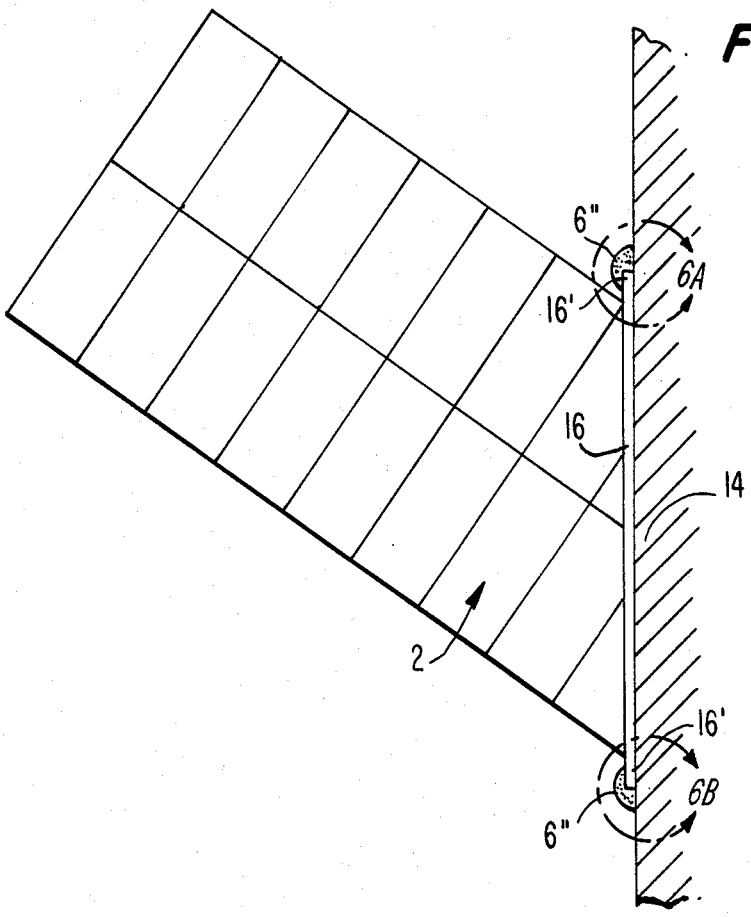
Figure 6A:
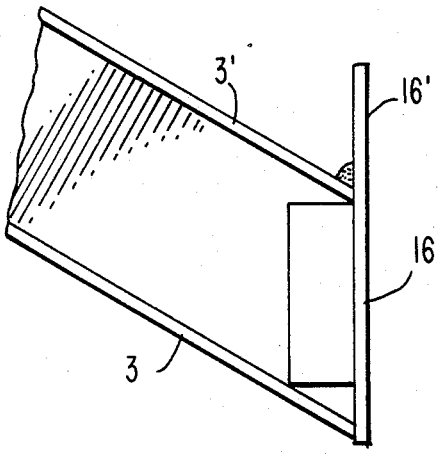
Figure 6B:
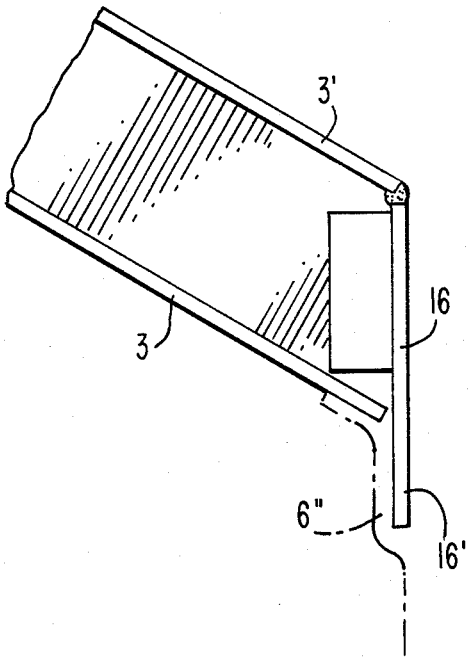
Figure 7:
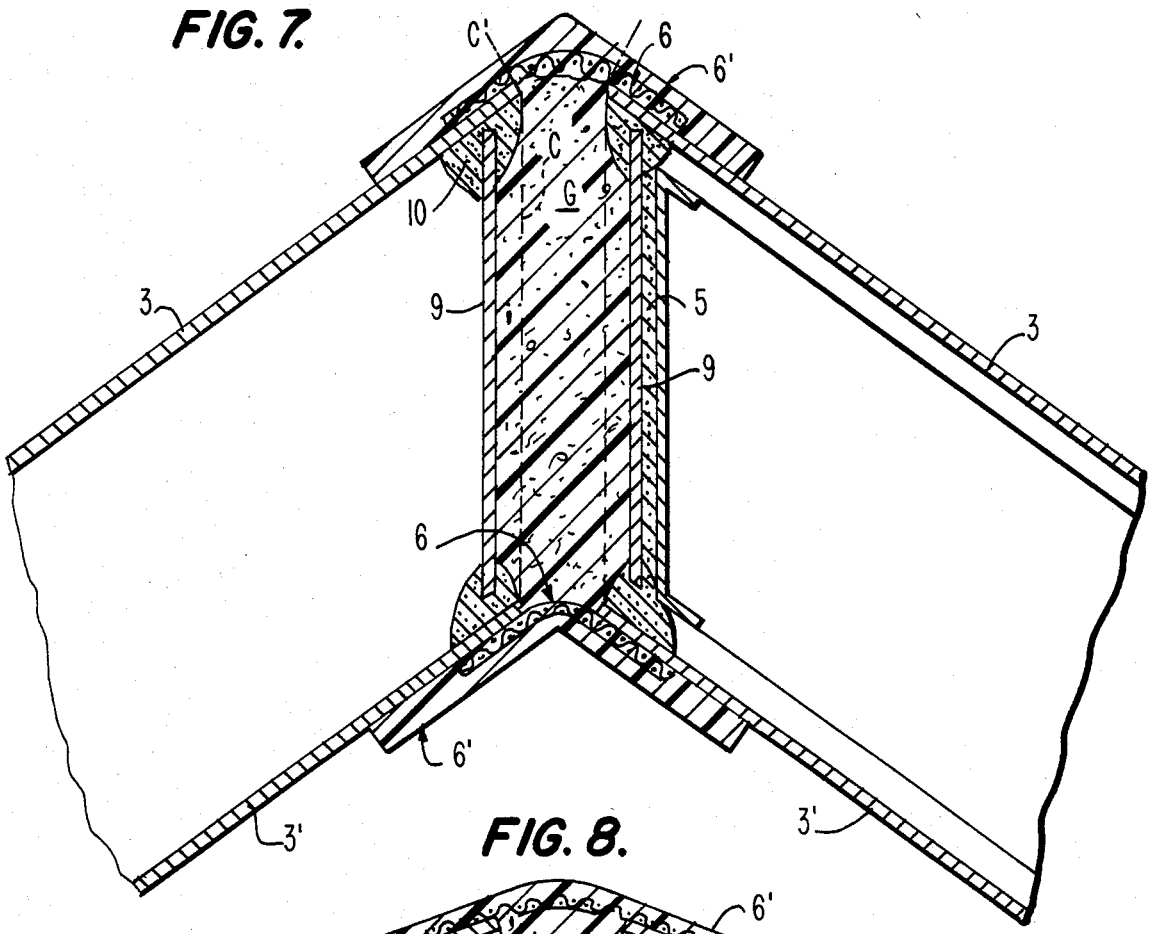
Figure 8:
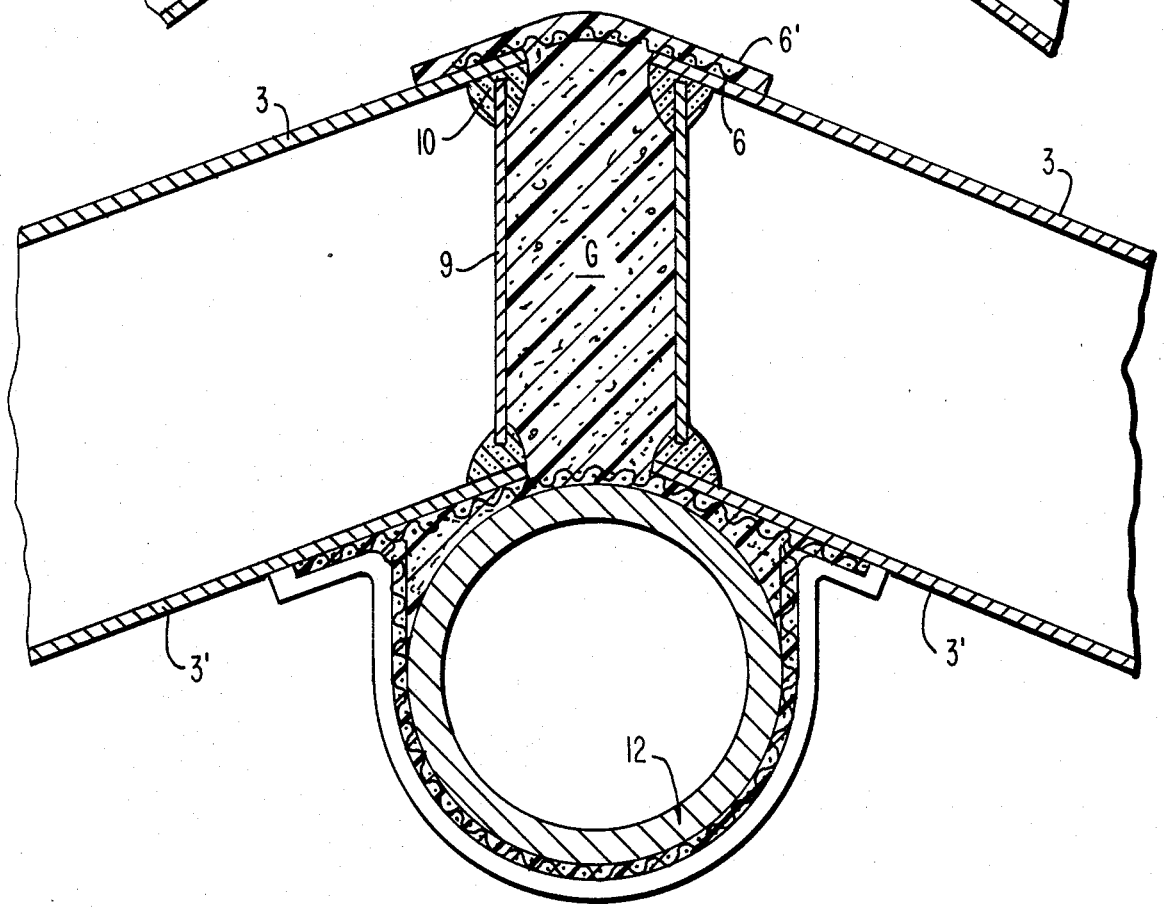

FIGS. 4A, B and C are, respectively, transverse sectional views of the seam of FIG. 1 taken along the lines A, B and C of FIG. 1;

FIGS. 5A and 5B are fragmentary longitudinal sections showing the edge cutting and end closure steps employed;

FIGS. 6, 6A and 6B are similar views of the panel prepared by the steps of FIGS. 5A and 5B for abutting a flat surface, such as a wall or the like; and FIGS. 7 and 8 are longitudinal sections, upon an enlarged scale, of a top joint region of abutting panels, FIG. 8 showing a modified externally reinforced joint.

Figure 2A:
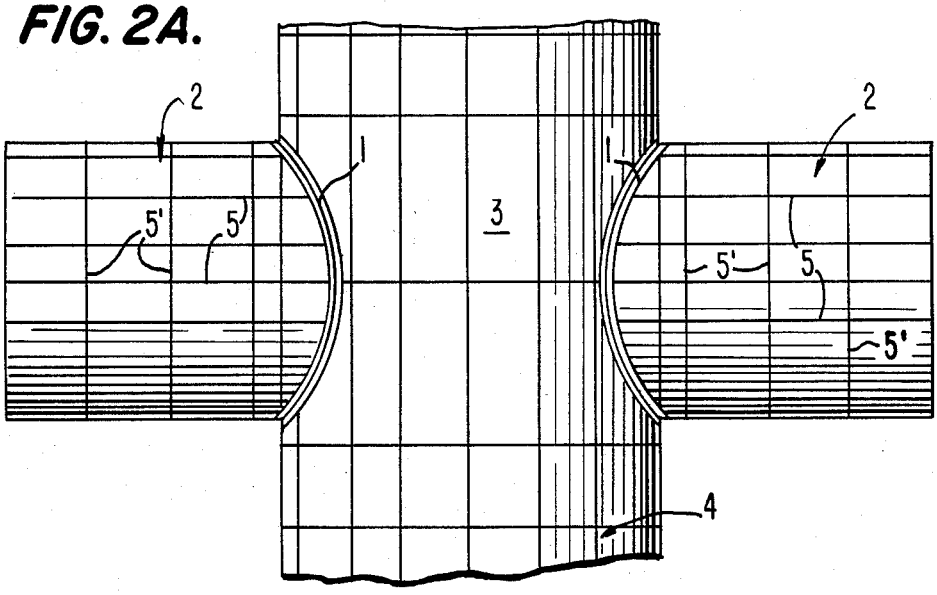
FIGS. 2A and 2B are respectfully plan and side views of the structure of FIG. 1, again illustrative of the complex joinder curve.
Figure 2B:
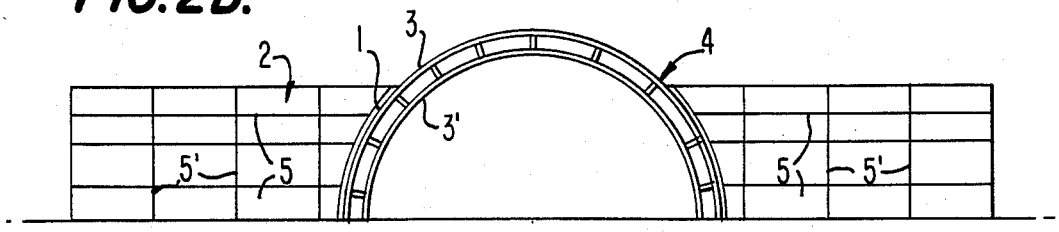

Referring to FIG. 1, as earlier described, as illustrative complex-curve joint or seam 1 is shown as required for joining curved vault domes 2–4 of different radii and heights and constructed of curvilinear panels as of the type described in said patent, the corresponding plan and side views of which are presented in FIGS. 2A and 2B with the predetermined lines of desired joinder. Each of the domes has outer and inner flexible fiberglass or similar coextensive coaxial curvilinear sheets 3 and 3', respectively, held spaced apart in panel form by internal longitudinal I-beam mullions and interconnecting transverse rib or munton members, as described in said patent, for example, and the respective glue-lines of which are shown at 5 and 5' visible through the sheets when of translucent or other light and heat-transmitting properties.

Figure 3:
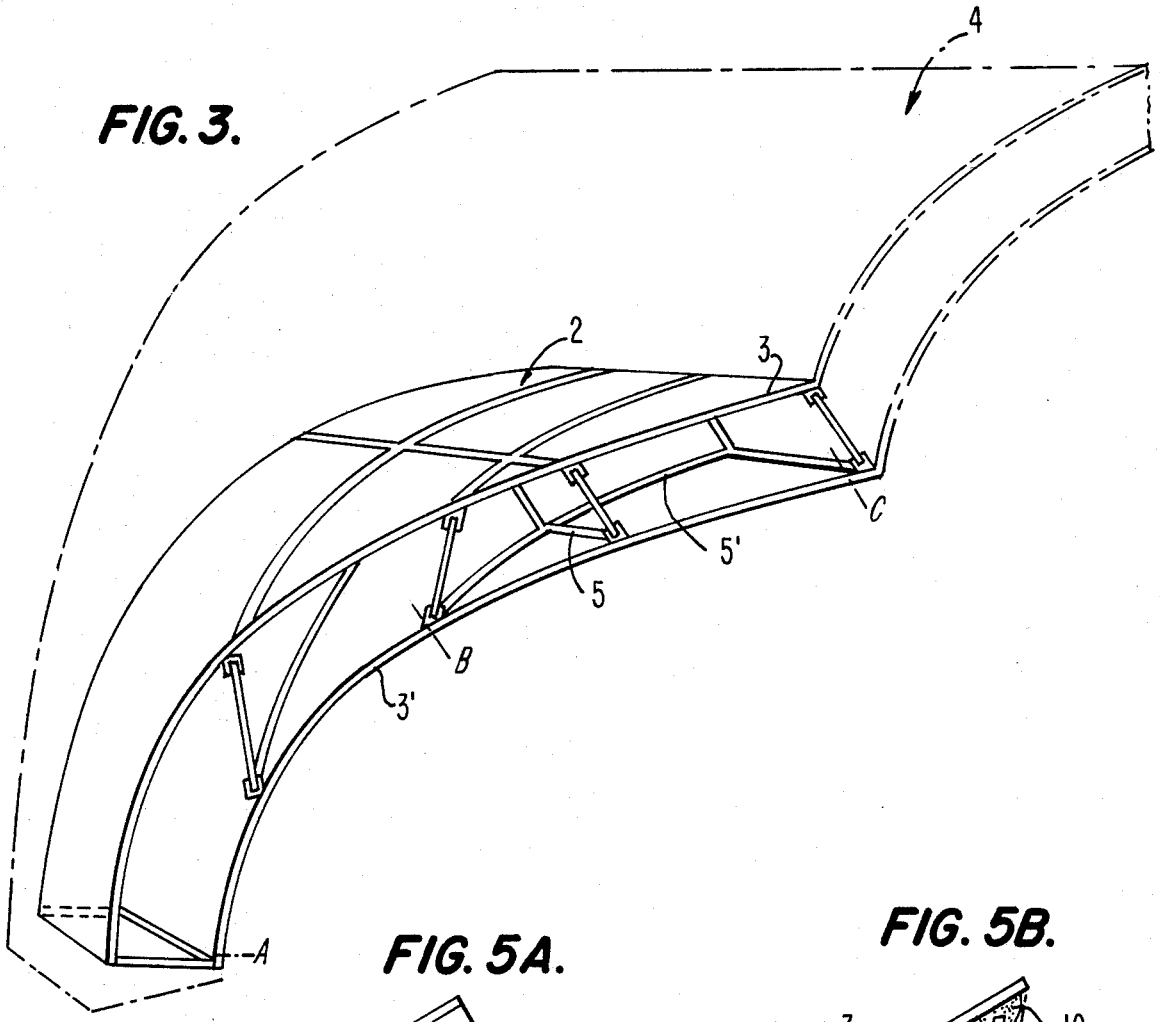
FIG. 3 is a fragmentary isometric with an edge cut away to show the type of somewhat ellipsoidal cuts required by the method of the invention to effect the joinder of adjacent curvilinear panels.

The plan view, FIG. 2A, particularly shows the nature of the cuts required in the panel structures to provide appropriate abutting edges for the desired joint 1. In FIG. 3, upon a larger scale, the detail of such predetermined cut is shown in longitudinal section, being effected in accordance with the invention as illustrated by the dotted diagnonal line C, with the actual panel sheet cuts at C' and C''. This results in the varying generally diagonal or angular cuts (with respect to the normal between the cover sheets) of the internal I-beam and cross-beam mullion and munton members 5 and 5', as shown, with the edge cut of the outer panel cover sheet 3 describing a somewhat elliptical curve, and that of the inner sheet 3', a different ellipse—and, such curves being different along the successive complex curving regions of the seam or joint 1.

Further in accordance with the technique of the invention, the thusly cut sections of the curvilinear panel 3-3' are provided just interiorly of the cut edges, as more particularly shown in FIG. 5B, with an end wall closure strip 9, as of sheet aluminum, fiberglass reinforced plastic or the like, sealed respectively to the inner surfaces of the panel cover sheets 3 and 3' at 10, as by structural adhesive sealant, and preferably oriented to extend between the panel cover sheets parallely to the cut line C, though recessed there behind, closing and sealing off the interior cell of the remainder of the panel. This end-wall sealing also accomodates for some sloppiness in the panel cutting. This is more clearly shown, upon an enlarged scale, with the top line joint region of FIG. 7 and in the modification of FIG. 8. In the detail of FIG. 7, moreover, the end closure 9 is shown fitted around a cut I-beam that happened to be near the panel edge cut; the adhesive sealant again effecting sealing closure.

The appropriate cut edges of the adjacent curvilinear panel structures-to-be-joined are then abutted, usually inherently with a small gap G therebetween, FIGS. 7 and 8 (and later described sections, FIGS. 4A–C), and exteriorly joined by successive overlapping layers of appropriate bonding material illustrated as a first structural bonding seam layer of epoxy and fiberglass cloth 6 and a second external layer 6' of somewhat greater width and of more cosmetic material such as polyester resins . . . of the type used as automobile body repair fillers, overlapping the outer and inner abutting novel edges and closing off the gap G, with a weather proof and structurally strong batten-like joint. If desired, the gap G may be provided with filler. In experimental tests extending over a year or so, such has not, however, been found to be required in practice. The use of a foam filler, at G, such as a urethane, however, can enhance the shear strength and insulating properties of the joint. The outer joining layers 6-6', which may extend parallel to the panel surfaces, as shown, and appear integral therewith, may be painted or otherwise decorated to resemble metal batten strips or the like and their width may be minimized to provide only narrow batten-like blocking of light transmission.

Figure 4B:
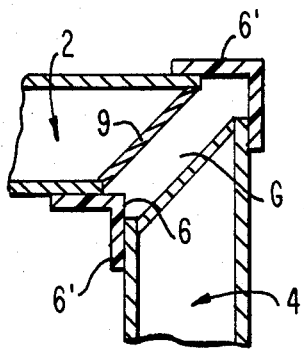
Figure 4C:
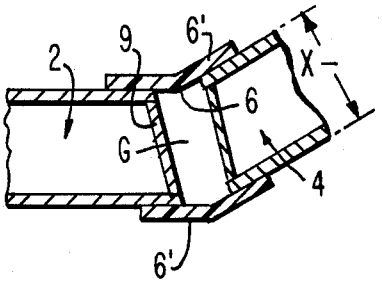

Returning to the joint 1 of FIGS. 1, 2A and 2B, and the substantially ellipsoidal panel cuts required for the practice of the present invention, the sections of FIGS. 4A–C, upon an enlarged scale, show the variation in width of the joined panels at different regions of the seal 1. FIG. 4A shows a width X+ near the bottom of the joint in FIG. 1 at the section line A; FIG. 4B, at the intermediate region B of FIG. 1, a somewhat lesser width; and FIG. 4C, near the top C, a smaller width X−, resulting from these substantially different ellipsoidal cut regions of the complex curve of the seam.

In the modification of FIG. 8, additional structural support for the joint is provided by encasing an aluminum, fiberglass or other tube or similar reinforcing member 12 along the joint or seam—shown along the inner seam and within the fiberglass-epoxy and bonding overlap layers 6 and 6'.

There are occasions, furthermore, when the joinder and the cut vault or other panel is to be effected against a rather flat surface such as a wall 14, as of brick, glass, etc., FIG. 6. By the use of an end plate or wall 16, with flange extensions 16' that will abut the wall 14 beyond the panel, such joints can be readily effected, again with appropriate bonding or adhesive sealant flashing layers applied by the installers, as at 6''. Similarly the panel may be otherwise used in the curved end cut form of the invention, being closed off and sealed by the end wall 9 or 16.

In all cases, moreover, the curving and bonding synergistically results in a very strong structure—doubly strong because of the inner and outer joints.

Other types of weather-proof and structural rigidity-providing joining battens, surfaces or closures may also be employed, as may other modifications readily be incorporated into the technique and structures of the invention, such being considered to fall within the spirit and scope of the invention as defined in the appended claims.

What is claimed is:

1. A method of joining curvilinear structural panels and the like having inner and outer parallel cover sheets held spaced apart by substantially longitudinally and transversely extending internal support members, that comprises, determining the lines of desired joining of adjacent panels; transversely cutting the panels to provide panel edges accomodating such a joining with substantially ellipsoidal transverse cuts, the ellipses for the outer and inner cover sheets being different and the internal support members being correspondingly cut along varying diagonal directions to the normal between the panel cover sheets; abutting a pair of panels thus cut that are to be joined with a small gap therebetween; and joining abutting panels with a weather-sealing and structurally connecting batten-like joint overlapping said edges both along the outer and inner panel cover sheet edges.

2. A method as claimed in claim 1 and in which, prior to the joining step and inwardly of the cut edges of each panel, the panel is closed off to seal its interior.

3. A method as claimed in claim 2 and in which the joining is effected by applying joining surfaces to overlap and connect the panel edges and seal any gap therebetween while providing structural rigidity to the joint.

4. A method as claimed in claim 3 and in which said cover sheets are of fiberglass and the joining comprises applying an epoxy-fiberglass overlapping structural layer over the abutting panel edges both at the outer and inner panel cover sheets, and superimposing a bonding layer thereover that covers and overlaps the same, with the layers extending against and parallel to the panel.

5. A method as claimed in claim 4 and in which said panel cover sheets are light-transmitting and the width of said bonding layers is controlled to minimize the blocking of light.

6. A method as claimed in claim 4 and in which a reinforcing member is incorporated into said bonding layer along the said line of panel joinder to add further structural rigidity.

7. A method as claimed in claim 3 and in which said gap is filled with a shear-strengthening material.

8. A pair of curvilinear structural panels joined along a line and each having inner and outer parallel cover sheets held spaced apart by substantially longitudinally and transversely extending internal support members, the abutting edges of each panel being transversely cut and disposed with a small gap therebetween and with the cuts defining substantially ellipsoidal curves extending along said line and that are different for the inner and outer panel cover sheet edges, and with the internal support members correspondingly cut along varying diagonal directions to the normal between the panel cover sheets; and batten-like joining surface means overlapping and connecting the abutting panel edges and closing off said gap on both the inner and outer panel cover sheets to provide structural rigidity and weatherproofing to the joinder of the panels.

9. A joined panel structure as claimed in claim 8 and in which a wall is provided inward of the cut edges of each panel and co-extensive with the opening defined thereby to seal off the interior of the panels.

10. A joined panel structure as claimed in claim 9 and in which the panel cover sheets are of fiberglass and the batten-like joining surface means comprises an epoxy-fiberglass structural layer overlapping the panel edges and covering said gap and covered by an overlapping bonding layer, said layers extending against and parallel to the panel cover sheets.

11. A joined panel structure as claimed in claim 9 and in which said panel cover sheets are light-transmitting and the width of said bonding layers is narrow to minimize the blocking of light.

12. A joined panel structure as claimed in claim 9 and in which a reinforcing member is incorporated into said bonding layer along the line of panel joinder to add further structural rigidity.

13. A joined panel structure as claimed in claim 8 and in which said gap is filled with a foam material to enhance shear strength.

14. A curvilinear panel structure for joining along a predetermined line to a wall surface and having inner and outer parallel cover sheets held spaced apart by substantially longitudinally and transversely extending internal support members, the edge of the panel being transversely cut to define at least in part substantially ellipsoidal curves extending along said line and that are different for the inner and outer panel cover sheet edges and with the internal support members correspondingly cut along varying diagonal directions to the normal between the panel cover sheets; and an end closure secured along said line to seal the interior of the panel within said cut edges, the end closure having flanges extending beyond either or both the cover sheets for abutting a wall along said line, the flanges being securable against the wall exteriorily of the panel.

15. A curvilinear panel structure having inner and outer parallel cover sheets held spaced apart by substantially longitudinally and transversely extending internal support members, the edge of the panel being transversely cut to define at least in part substantially ellipsoidal curves that are different for the inner and outer panel cover sheet edges and with the internal support members correspondingly cut along varying diagonal directions to the normal between the panel cover sheets; and an end closure secured along said line to seal the interior of the panel within said cut edges.

16. A method of joining curvilinear structural panels and the like having inner and outer parallel cover sheets held spaced apart by substantially longitudinally and transversely extending internal support members, that comprises, determining the lines of desired joining of adjacent panels; transversely shaping the panels to provide panel edges accomodating such a joining with at least portions of substantially ellipsoidal transverse contour, the ellipses for the outer and inner cover sheets being different and the internal support members being correspondingly cut along varying diagonal directions to the normal between the panel cover sheets; abutting the edges of the pair of panels that are to be joined; and structurally connecting the abutted panels edges with a weather-sealing and batten-like joint overlapping said edges both along the outer and inner panel cover sheet edges.

* * * * *